United States Patent [19]

Zimmermann

[11] Patent Number: 4,976,793

[45] Date of Patent: Dec. 11, 1990

[54] EXPLOSIVE COMPOSITION

[75] Inventor: Leon M. Zimmermann, Johannesburg, South Africa

[73] Assignee: Dantex Explosives (Proprietary) Limited, South Africa

[21] Appl. No.: 536,707

[22] Filed: Jun. 12, 1990

[51] Int. Cl.[5] ..... C06G 45/02

[52] U.S. Cl. ..... 149/21; 149/2; 149/109.6

[58] Field of Search ..... 149/21, 2, 109.6

[56] References Cited

U.S. PATENT DOCUMENTS

| | | | |
|---|---|---|---|
| 4,364,782 | 12/1982 | Funk et al. | 149/21 |
| 4,380,482 | 4/1983 | Sandell | 149/21 |
| 4,486,317 | 12/1989 | Sandell | 199/21 |

*Primary Examiner*—Stephen J. Lechert, Jr.

*Attorney, Agent, or Firm*—Ladas & Parry

[57] ABSTRACT

A permitted water-bearing explosive composition of the watergel or emulsion type contains a suitable amount, e.g. 0.5% by weight of the composition, of a non-passivated paint flake aluminum having a surface area of 5000 $cm^2/g$ or greater and a suitable amount of one or more alkali or alkaline earth metal or ammonium halides, perferably potassium chloride.

8 Claims, No Drawings

EXPLOSIVE COMPOSITION

BACKGROUND OF THE INVENTION

This invention relates to a permitted water-bearing explosive composition of either the watergel or emulsion type and to a method of making such a composition.

In general, a permitted or permissible explosive composition is one which has been passed for use by the relevant authorities in fiery mines. The explosive composition must not ignite a mixture of methane and air when the explosive composition is detonated. It has been believed that such permitted explosive composition cannot contain a significant amount of paint flake aluminium because of the high probability that, on detonation, such paint flake aluminium would cause ignition of a methane/air mixture.

In West German Patent No. P2350605.0-45 in the name of IDL Chemicals Limited, there is disclosed a cap sensitive permissible slurry explosive composition which contains an inorganic oxidiser salt, a fuel and a suitable thickening agent. This composition also contains an amount of passivated, finely divided aluminium and a coolant salt. The finely divided aluminium is passivated by treating it with a mono or polyhydroxy alcohol to form a paste, and then adding this passivated aluminium paste to the explosive composition. The coolant salt, which may be common salt, is added in the first step of preparation of the explosive composition when a solution is made of the oxidiser salt or salts.

In South Afican Patent No. 87/2089 in the name of AECI Limited there is disclosed a permitted explosive of the slurry type which comprises a water-soluble inorganic oxidising salt; a water-soluble organic fuel; water; a substance which functions as a heat-absorbing material to reduce the flame temperature of the explosive upon detonation thereof, e.g. calcium nitrate of calcium carbonate; a substance which functions as a flame suppressant, e.g. a metal halide salt such as sodium chloride; and aluminium. The aluminium makes up 1.2 to 1.6% m/m of the explosive, at least 40% m/m of the aluminium being atomized aluminium and any balance of the aluminium being paint fine aluminium.

Atomized aluminium, which differs in shape, size and properties from paint flake (also known as paint fine, paint grade or pigment flake) aluminium, generally has a surface area of up to 1500 $cm^2/g$. It is possible to obtain atomized aluminium of 1 micron particle size which may have a surface area of up to 4000 $cm^2/g$, but this material is very sensitive and is used only for very specialized applications.

Thus the explosive disclosed in this patent contains no more than 0.96% m/m, (preferably about 0.75% m/m) of the explosive of paint flake aluminium.

The flame suppressant is present in a proportion of 3–4% m/m of the explosive.

SUMMARY OF THE INVENTION

According to a first aspect of the invention there is provided a permitted water-bearing explosive composition of the watergel or emulsion type which is characterised in that it contains a suitable amount of a non-passivated paint flake aluminium having a surface area of 5000 $cm^2/g$ or greater and no other aluminium and a suitable amount of one or more alkali or alkaline earth metal or ammonium halides.

By "permitted" there is meant an explosive composition which is permitted for use in South Afican coal mines.

By "non-passivated particulate aluminium" there is meant particulate aluminium which has not been treated with a passivating agent such as a mono or polyhydroxy alcohol as is disclosed in West German Patent No. P2350605.0-45.

According to a second aspect of the invention there is provided a method of making a permitted water-bearing explosive composition containing a suitable amount of a non-passivated paint flake aluminium having a surface area of 5000 $cm^2/g$ or greater and no other aluminium and a suitable amount of one or more alkali or alkaline earth metal or ammonium halides which includes the steps of forming the explosive composition and then adding to the explosive composition the paint flake aluminium and the one or more halides.

DESCRIPTION OF EMBODIMENTS

The crux of the present invention is that there is provided a permitted water-bearing explosive composition of the watergel or emulsion type which contains paint flake aluminium.

As is stated above, by "permitted" there is meant an explosive composition which is permitted for use in South Afican coal mines. This means firstly that the explosive composition must conform to the South African Bureau of Standards specification SABS 1484–1989. The specifications requires that an explosive composition be subjected to three series of tests. In the first series of tests, 26 samples of 140 g each of explosive composition are fired unstemmed into a 9% methane/air mixture. In the second series of tests, 10 samples of 800 g each of explosive composition are fired, stemmed, into a 9% methane/air mixture. In the third series of tests, five samples of 800 g each of explosive composition are fired, stemmed, into 1120 g of coal dust suspended in 10 $m^3$ of air. In all these tests, the explosive composition must not ignite the methane/air mixture or the coal dust/air mixture. Once the explosive composition has passed the specification tests, it must be used for 100,000 shots (1 shot being 800 g of explosive composition) in a fiery mine without causing any ignition of a methane/air mixture. If the explosive composition passes this test, then it is included on the permitted list of explosive by the Government mining engineer.

A watergel explosive composition in general comprises an oxidising agent, a fuel and a sensitiser in a thickened or gelled continuous aqueous phase.

Preferably, the oxidising agent comprises from 35% to 80% by weight of the composition. Suitable oxidising agents include ammonium, alkali metal and alkaline earth metal nitrates and perchlorates. Specific examples of such salts are ammonium nitrates, ammonium perchlorates , sodium nitrate, sodium perchlorate, potassium nitrate, potassium perchlorate, magnesium nitrate, magnesium perchlorate and calcium nitrate. A preferred oxidising agent is ammonium nitrate, either alone or in combination with one or more other oxidising agents.

The fuel component for a watergel explosive composition may be any one which is known in the art. Non-explosive fuels include sulphur and carbonaceous fuels such as finely divided coal, gilsonite and other forms of finely divided carbon; semi-carbonaceous fuels; solid carbonaceous vegetable products such as cornstarch, wood pulp, sugar, ivory nut meal and bagasse; and hydrocarbons such as fuel oil, paraffin wax and rubber.

The sensitiser component of a watergel explosive composition may comprise for example a nitrate salt of a primary amine or hydroxy amine containing 3 carbon atoms or less. Suitable sensitisers include methylamine nitrate and ethanolamine nitrate. The sensitiser may also be an explosive sensitiser such as TNT, or the non-passivated paint flake aluminium which is added to the watergel explosive composition, may act as the sensitiser.

The watergel explosive composition is thickened with a suitable thickening agent, known in the art, for example, guar gum, locust bean gum, polyacrylamide, carboxymethyl cellulose, xanthan gum and galactomannan. This is used in an amount sufficient to produce a viscosity in the explosive composition sufficient to hold the components of the explosive composition together. The thickening agent may comprise from about 0.1% to about 5% by weight of the explosive composition.

The watergel explosive composition may also include additional agents such as density controlling substances, e.g. Perlite or glass microballoons, a chemical cross-linker for the thickening agent such as potassium pyroantimonate and a proton acceptor such as calcium carbonate.

An emulsion explosive composition in general comprises a continuous fuel phase and a discontinuous phase comprising one or more oxidising agents in a solvent therefor.

The continuous fuel phase is generally comprised of an oil or a mixture of oil and wax, and a suitable emulsifier such as the sorbitan esters of oleic acid, lauric acid or stearic acid.

The discontinuous phase comprises one or more oxidising agents or salts and a solvent therefor. Suitable salts include the nitrates and perchlorates of ammonia, of the alkali metals and the alkaline earth metals, of methylamine, of ethylamine, of propylamine, of ethanolamine and of propanolamine. Preferably, the oxidising agent comprises ammonium nitrate, optionally mixed with one or more of the other oxidising agents listed above.

The emulsion explosive composition may also include other agents such as a fuel soluble sensitiser, e.g. dinitrotoluene, a quantity of gas generating chemicals to produce voids in the final product such as for example urea or thiourea and sodium nitrite to generate nitrogen, and a void containing material such as Perlite or glass microballoons or plastic microballoons.

the explosive composition of the invention contains a suitable amount of a non-passivated paint flake aluminium having a surface area of 5000 $cm^2/g$ or greater, preferably 10,000 $cm^2/g$ or greater, more preferably 20,000 $cm^2/g$ or greater.

The explosive composition of the invention contains no other aluminium such as atomized aluminium.

The amount of paint flake aluminium added into the explosive composition of the invention will depend on the required increase in energy of the explosive composition.

The explosive composition of the invention also includes one or more alkali or alkaline earth metal or ammonium halides to render the explosive composition non-incendiary. Suitable halides include sodium chloride and more preferably potassium chloride. The amount of halide in the explosive composition of the invention will depend on the amount of paint flake aluminium in the explosive composition of the invention.

Preferably, the explosive composition of the invention contains from 0.5% to 2.5%, more preferably from 1% to 2.5% inclusive by weight of the composition of the non-passivated paint flake aluminium and from 8% by weight of the composition of the halide or halides.

The second aspect of the invention is a method of making the explosive composition of the invention. The crux of this method is that the paint flake aluminium and the one or more halides are added once the explosive composition has been formed.

thus, for a watergel explosive composition, the method comprises the following steps:

(a) forming a solution of the oxidising agent in water;

(b) adding the fuel and the sensitiser and any other optional ingredients;

(c) adding the thickening or gelling agent and allowing the mixture to thicken;

(d) once the desired viscosity is reached, adding the paint flake aluminium and then the one or more halides; and (e) optionally adding a cross-linking agent.

For an emulsion explosive composition, the method of the invention comprises the following steps:

(f) preparing a solution of the oxidising agent in the solvent;

(g) preparing the fuel solution;

(h) adding the oxidising agent solution to the fuel solution and mixing to produce an emulsion; and (i) adding the emulsion the paint flake aluminium and then the one or more halides.

In a watergel explosive composition, the paint flake aluminium contributes both to the sensitivity of the composition and to the energy of the composition. In an emulsion explosive composition, the paint flake aluminium only contributes to the energy of the composition.

Examples of the invention will now be given.

In the following examples one shot of 800 g of product made from each formulation, was test fired in accordance with the series II test of SABS 1484–1989. A pass is recorded if no ignition occurs; a fail is recorded if the methane/air mixture ignites.

This test was chosen as a good indication of the likelihood that a particular formulation will pass the SABS 1484–1989 specification.

| Mix No | Methylamine Nitrate | Ammonium Nitrate | Sodium Nitrate | Water | Pigment Aluminium | Potassium Chloride | Result |
|---|---|---|---|---|---|---|---|
| 1 | 23.4% | 43.8% | 10% | 10.9% | 0.5% | 8.0% | PASS |
| 2 | 15.4% | 47.2% | 9.9% | 9.1% | 1.5% | 11.9% | PASS |
| 3 | 15.5% | 48.9% | 9.9% | 9.3% | 1.5% | 9.9% | PASS |
| 4 | 23.0% | 36.9% | 9.8% | 10.1% | 2.5% | 13.8% | PASS |
| 5 | 23.2% | 38.9% | 9.9% | 10.3% | 2.5% | 11.9% | PASS |
| 6 | 23.1% | 40.4% | 9.9% | 10.4% | 2.5% | 9.9% | PASS |

-continued

| Mix No | Methylamine Nitrate | Ammonium Nitrate | Sodium Nitrate | Water | Pigment Aluminium | Potassium Chloride | Result |
|---|---|---|---|---|---|---|---|
| 7 | 23.3% | 40.9% | 10.0% | 10.7% | 1.5% | 10.0% | PASS |

(All percentages given are by weight).

All the above mixes were prepared as follows: To a mixer was added methylamine nitrate solution. Ammonium nitrate solution was then added in sufficient quantity to obtain the desired percentage water. Sodium nitrate was then added together with any additional ammonium nitrate required. Sufficient ground rubber was then added to render an oxygen balanced final product, followed by sufficient Perlite to render the product cap sensitive.

Guar gum premixed with ammonium nitrate was then added to the mix. After the mix had thickened sufficiently, pigment flake aluminium was added followed by fertilizer grade potassium chloride. Finally a chemical crosslinker was added.

| Mix No | Ammonium Nitrate | Sodium Nitrate | Water | Fuel | Pigment Aluminium | Potassium Chloride | Density g/cm |
|---|---|---|---|---|---|---|---|
| 8 | 58.0% | 14.9% | 10.0% | 5.5% | 1.5% | 10.0% | 1.1 |
| 9 | 56.0% | 15.0% | 10.0% | 5.5% | 1.5% | 12.0% | 1.1 |
| 10 | 54.0% | 15.0% | 10.0% | 5.5% | 1.5% | 14.0% | 1.1 |

The Results for Mixes 8 to 10 inclusive were Pass.
(All percentages given are by weight).

Mixes 8 to 10 inclusive were produced as follows: A fuel blend was prepared from waxes, oils and emulsifiers. This was heated to 70 degrees centigrade and placed in a mixer. The mixer was turned on at high speed and the oxidiser solution (consisting of the ammonium nitrate and the sodium nitrate dissolved in the water) was added slowly to the fuel. When addition was complete, mixing was continued until the desired density was achieved. While still hot the product was packed into plastic tubing and closed with copper clips. The product was allowed to cool. Some time later the samples were tested as described above. No methane ignitions occurred with any of the mixes 8 to 10 inclusive.

I claim:

1. A permitted water-bearing explosive composition of the watergel or emulsion type is characterized in that it contains a suitable amount of a non-passivated paint flake aluminium having a surface area of 5000 $cm^2/g$ or greater and no other aluminium and a suitable amount of one or more alkali or alkaline earth metal or ammonium halides.

2. An explosive composition according to claim 1 which is characterised in that it contains from 0.5% to 2.5% inclusive by weight of the composition of the non-passivated paint flake aluminium and from 8% by weight of the composition of one or more alkali or alkaline earth metal or ammonium halides.

3. An explosive composition according to claim 2 which is characterized in that it contains from 1% to 2.5% inclusive by weight of the composition of the non-passivated paint flake aluminium.

4. An explosive composition according to claim 1 which is characterised in that it contains a suitable amount of a non-passivated particulate aluminium having a surface area of 10,000 $cm^2/g$ or greater.

5. An explosive composition according to claim 4 which is characterised in that it contains a suitable amount of a non-passivated particulate aluminium having a surface area of 20,000 $cm^2/g$ or greater.

6. An explosive composition according to claim 1 which is characterised in that it contains a suitable amount of sodium chloride.

7. An explosive composition according to claim 1 which is characterised in that it contains a suitable amount of potassium chloride.

8. A method of making a permitted water-bearing explosive composition containing a suitable amount of a non-passivated paint flake aluminium having a surface area of 5000 $cm^2/g$ or greater and no other aluminium and a suitable amount of one or more alkali or alkaline earth metal or ammonium halides includes the steps of forming the explosive composition and then adding to the explosive composition the paint flake aluminium and the one or more halides.

* * * * *